US007959761B2

(12) United States Patent
Boettcher et al.

(10) Patent No.: US 7,959,761 B2
(45) Date of Patent: Jun. 14, 2011

(54) CREPING ADHESIVE MODIFIER AND PROCESS FOR PRODUCING PAPER PRODUCTS

(75) Inventors: Jeffery J. Boettcher, Appleton, WI (US); Nancy S. Clungeon, Manawa, WI (US); Bruce J. Kokko, Neenah, WI (US); Elroy W. Post, Oshkosh, WI (US); Phuong V. Luu, Appleton, WI (US); Gary L. Worry, Appleton, WI (US); Greg A. Wendt, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 10/409,042

(22) Filed: Apr. 9, 2003

(65) Prior Publication Data

US 2005/0006040 A1 Jan. 13, 2005

Related U.S. Application Data

(60) Provisional application No. 60/372,255, filed on Apr. 12, 2002.

(51) Int. Cl.
*B31F 1/12* (2006.01)

(52) U.S. Cl. ..... 162/111; 162/164.6; 162/158; 162/179; 264/283; 156/183

(58) Field of Classification Search ..... 162/111–113, 162/179, 164.1, 164.6, 168.2, 158; 264/282–283; 156/183; 525/430, 435; 524/606; 528/342
See application file for complete search history.

(56) References Cited

U.S. PATENT DOCUMENTS

| | | | | |
|---|---|---|---|---|
| 2,926,116 | A | | 2/1960 | Keim |
| 3,058,873 | A | | 10/1962 | Keim |
| 3,301,746 | A | | 1/1967 | Sanford et al. |
| 3,545,705 | A | | 12/1970 | Hodgson |
| 3,549,742 | A | | 12/1970 | Benz |
| 3,556,932 | A | | 1/1971 | Coscia et al. |
| 3,556,933 | A | | 1/1971 | Coscia et al. |
| 3,640,841 | A | | 2/1972 | Winslow et al. |
| 3,700,623 | A | | 10/1972 | Keim |
| 3,772,076 | A | | 11/1973 | Keim |
| 3,858,623 | A | | 1/1975 | Lefkowitz |
| 3,905,863 | A | | 9/1975 | Ayers |
| 3,974,025 | A | | 8/1976 | Ayers |
| 4,041,989 | A | | 8/1977 | Johansson et al. |
| 4,071,050 | A | | 1/1978 | Codorniu |
| 4,112,982 | A | | 9/1978 | Bugge et al. |
| 4,149,571 | A | | 4/1979 | Burroughs |
| 4,157,276 | A | | 6/1979 | Wandel et al. |
| 4,161,195 | A | | 7/1979 | Khan |
| 4,182,381 | A | | 1/1980 | Gisbourne |
| 4,184,519 | A | | 1/1980 | McDonald et al. |
| 4,191,609 | A | | 3/1980 | Trokhan |
| 4,239,065 | A | | 12/1980 | Trokhan |
| 4,314,589 | A | | 2/1982 | Buchanan et al. |
| 4,355,021 | A | * | 10/1982 | Mahl et al. ..... 424/443 |
| 4,359,069 | A | | 11/1982 | Hahn |
| 4,376,455 | A | | 3/1983 | Hahn |
| 4,379,735 | A | | 4/1983 | MacBean |
| 4,453,573 | A | | 6/1984 | Thompson |
| 4,501,640 | A | * | 2/1985 | Soerens ..... 162/111 |
| 4,514,345 | A | | 4/1985 | Johnson et al. |
| 4,528,339 | A | | 7/1985 | Coleman, III et al. |
| 4,529,480 | A | | 7/1985 | Trokhan |
| 4,564,052 | A | | 1/1986 | Borel |
| 4,592,395 | A | | 6/1986 | Borel |
| 4,603,176 | A | | 7/1986 | Bjorkquist et al. |
| 4,605,585 | A | | 8/1986 | Johansson |
| 4,605,702 | A | | 8/1986 | Guerro et al. |
| 4,611,639 | A | | 9/1986 | Bugge |
| 4,637,859 | A | | 1/1987 | Trokhan |
| 4,640,741 | A | | 2/1987 | Tsuneo |
| 4,675,394 | A | | 6/1987 | Solarek et al. |
| 4,709,732 | A | | 12/1987 | Kinnunen |
| 4,720,383 | A | | 1/1988 | Drach et al. |
| 4,759,391 | A | | 7/1988 | Waldvogel et al. |
| 4,759,976 | A | | 7/1988 | Dutt |
| 4,804,769 | A | | 2/1989 | Solarek et al. |
| 4,866,151 | A | | 9/1989 | Tsai et al. |
| 4,942,077 | A | * | 7/1990 | Wendt et al. ..... 428/152 |
| 4,967,085 | A | | 10/1990 | Bryan et al. |
| 4,973,512 | A | | 11/1990 | Stanley et al. |
| 4,981,557 | A | | 1/1991 | Bjorkquist |
| 4,983,748 | A | | 1/1991 | Tsai et al. |
| 4,998,568 | A | | 3/1991 | Vöhringer |

(Continued)

FOREIGN PATENT DOCUMENTS

| | | |
|---|---|---|
| CA | 2 315 623 | 7/1999 |

(Continued)

OTHER PUBLICATIONS

Witco Corporation, "Softenre, Debonder and Antistats for Tissues and Towels," pp. 1-4, 1994.*

(Continued)

*Primary Examiner* — José A Fortuna
(74) *Attorney, Agent, or Firm* — Finnegan, Henderson, Farabow, Garrett & Dunner, LLP

(57) ABSTRACT

The present invention relates to the use of a quaternary ammonium complex comprising at least one non-cyclic amide as a modifier for a creping adhesive used on a creping cylinder, e.g., a Yankee dryer.

36 Claims, 2 Drawing Sheets

U.S. PATENT DOCUMENTS

| | | | | | |
|---|---|---|---|---|---|
| 5,008,344 | A | | 4/1991 | Bjorkquist | |
| 5,016,678 | A | | 5/1991 | Borel et al. | |
| 5,023,132 | A | | 6/1991 | Stanley et al. | |
| 5,025,046 | A | * | 6/1991 | Soerens | 524/72 |
| 5,054,525 | A | | 10/1991 | Vöhringer | |
| 5,066,532 | A | | 11/1991 | Gaisser | |
| 5,085,736 | A | | 2/1992 | Bjorkquist | |
| 5,098,519 | A | | 3/1992 | Ramasubramanian et al. | |
| 5,103,874 | A | | 4/1992 | Lee | |
| 5,114,777 | A | | 5/1992 | Gaisser | |
| 5,138,002 | A | | 8/1992 | Bjorkquist | |
| 5,167,261 | A | | 12/1992 | Lee | |
| 5,182,164 | A | | 1/1993 | Eklund et al. | |
| 5,199,467 | A | | 4/1993 | Lee | |
| 5,211,815 | A | | 5/1993 | Ramasubramanian et al. | |
| 5,217,576 | A | | 6/1993 | Van Phan | |
| 5,219,004 | A | | 6/1993 | Chiu | |
| 5,223,092 | A | | 6/1993 | Grinnell et al. | |
| 5,223,096 | A | | 6/1993 | Phan et al. | |
| 5,225,269 | A | | 7/1993 | Bohlin | |
| 5,234,547 | A | * | 8/1993 | Knight et al. | 162/111 |
| 5,240,562 | A | | 8/1993 | Phan et al. | |
| 5,245,025 | A | | 9/1993 | Trokhan et al. | |
| 5,260,171 | A | | 11/1993 | Smurkoski et al. | |
| 5,262,007 | A | | 11/1993 | Phan et al. | |
| 5,264,082 | A | | 11/1993 | Phan et al. | |
| 5,275,799 | A | | 1/1994 | Keijsper et al. | |
| 5,277,761 | A | | 1/1994 | Van Phan et al. | |
| 5,312,522 | A | | 5/1994 | Van Phan et al. | |
| 5,314,584 | A | | 5/1994 | Grinnell et al. | |
| 5,328,565 | A | | 7/1994 | Rasch et al. | |
| 5,334,289 | A | | 8/1994 | Trokhan et al. | |
| 5,338,807 | A | | 8/1994 | Espy et al. | |
| 5,364,504 | A | | 11/1994 | Smurkoski et al. | |
| 5,368,696 | A | | 11/1994 | Cunnane, III et al. | |
| 5,372,876 | A | | 12/1994 | Johnson et al. | |
| 5,373,087 | A | | 12/1994 | Weaver, Jr. et al. | |
| 5,379,808 | A | | 1/1995 | Chiu | |
| 5,382,323 | A | * | 1/1995 | Furman et al. | 162/111 |
| 5,415,737 | A | | 5/1995 | Phan et al. | |
| 5,429,686 | A | | 7/1995 | Chiu et al. | |
| 5,456,293 | A | | 10/1995 | Ostermayer et al. | |
| 5,494,554 | A | * | 2/1996 | Edwards et al. | 162/111 |
| 5,529,665 | A | * | 6/1996 | Kaun | 162/111 |
| 5,618,612 | A | | 4/1997 | Gstrein | |
| 5,657,797 | A | | 8/1997 | Townley et al. | |
| 5,660,687 | A | * | 8/1997 | Allen et al. | 162/111 |
| 5,685,954 | A | | 11/1997 | Marinack et al. | |
| 5,730,839 | A | * | 3/1998 | Wendt et al. | 162/111 |
| 5,753,079 | A | * | 5/1998 | Jenny et al. | 162/158 |
| 5,846,380 | A | * | 12/1998 | Van Phan et al. | 162/111 |
| 5,853,539 | A | | 12/1998 | Smith et al. | |
| 5,885,417 | A | | 3/1999 | Marinack et al. | |
| 5,908,533 | A | | 6/1999 | Marinack et al. | |
| 5,908,553 | A | | 6/1999 | Reid | |
| 5,961,782 | A | | 10/1999 | Luu et al. | |
| 6,066,234 | A | | 5/2000 | Parker et al. | |
| 6,133,405 | A | | 10/2000 | Allen | |
| 6,207,011 | B1 | | 3/2001 | Luu et al. | |
| 6,277,242 | B1 | * | 8/2001 | Archer et al. | 162/111 |
| 6,336,995 | B1 | * | 1/2002 | Campbell | 162/111 |
| 6,420,013 | B1 | * | 7/2002 | Vinson et al. | 428/154 |
| 6,440,267 | B1 | * | 8/2002 | Rekoske et al. | 162/111 |
| 6,468,392 | B2 | * | 10/2002 | Oriarian et al. | 162/109 |
| 6,579,416 | B1 | * | 6/2003 | Vinson et al. | 162/158 |
| 6,969,443 | B1 | * | 11/2005 | Kokko | 162/5 |
| 6,991,707 | B2 | * | 1/2006 | Hill et al. | 162/111 |
| 2003/0019597 | A1 | * | 1/2003 | Hill et al. | 162/111 |
| 2003/0041989 | A1 | * | 3/2003 | Oriarian et al. | 162/184 |
| 2003/0136531 | A1 | * | 7/2003 | Edwards et al. | 162/111 |
| 2004/0057982 | A1 | * | 3/2004 | Vinson et al. | 424/443 |
| 2004/0211534 | A1 | * | 10/2004 | Clungeon et al. | 162/111 |
| 2004/0238135 | A1 | * | 12/2004 | Edwards et al. | 162/111 |
| 2005/0006040 | A1 | * | 1/2005 | Boettcher et al. | 162/111 |
| 2006/0000567 | A1 | * | 1/2006 | Murray et al. | 162/111 |
| 2006/0207736 | A1 | * | 9/2006 | Boettcher et al. | 162/112 |
| 2006/0237154 | A1 | * | 10/2006 | Edwards et al. | 162/111 |

FOREIGN PATENT DOCUMENTS

| | | | | |
|---|---|---|---|---|
| CA | 2 205 649 | | | 10/2003 |
| EP | 399522 | A2 | * | 11/1990 |
| EP | 0479554 | A2 | | 4/1992 |
| EP | 0 525 271 | A1 | | 2/1993 |
| EP | 0541232 | A1 | | 5/1993 |
| EP | 0743172 | A1 | | 11/1996 |
| EP | 1013825 | A1 | | 6/2000 |
| EP | 1094155 | A2 | * | 4/2001 |
| EP | 1353010 | A1 | * | 10/2003 |
| EP | 1703019 | A1 | * | 9/2006 |
| WO | 96/05372 | A1 | | 2/1996 |
| WO | 99/23298 | A1 | | 5/1999 |
| WO | 99/32720 | A1 | | 7/1999 |
| WO | WO/01/85109 | | | 11/2001 |

OTHER PUBLICATIONS

Wikipedia Definition of Oligomer.*

H. Espy, Chapter 2: Alkaline-Curing Polymeric Amine-Epichlorohydrin Resins, *Wet-Strength Resins and Their Application*, 1994, L. Chan, Editor, pp. 14-44.

L. Westfelt , Chemistry of Paper Wet-Strength. I. A survey of Mechanisms of Wet-Strength Development, Cellulose Chemistry and Technology, 1979, vol. 13, p. 813-825.

W.P. Evans, Cationic Fabric Softeners, Chemistry and Industry, Jul. 5, 1969, pp. 893-903.

R. R. Egan, Cationic Surface Active Agents as Fabric Softeners, J. Am. Oil Chemist's Soc., vol. 55, 1978, pp. 118-121.

B.C. Trivedi et al., Quarternization of Imidazoline: Unequivocal Structure Proof, J. Am. Oil Chemist's Soc., Jun. 1981, pp. 754-756.

* cited by examiner

CREPING ADHESIVE MODIFIER AND PROCESS FOR PRODUCING PAPER PRODUCTS

This application claims the right to priority based on U.S. Provisional Patent Application No. 60/372,255 filed Apr. 12, 2002.

The present invention relates to the use of at least one quaternary ammonium complex comprising at least one non-cyclic amide as a modifier for a creping adhesive for producing creped paper. More particularly, the present invention relates to a creping adhesive including a modifier and a method of using the modifier to soften the creping adhesive resulting in a creped product having a more uniform crepe and a creping operation that is stable. Finally, the present invention relates to an improved paper product produced using a creping adhesive modified with at least one quaternary ammonium complex comprising at least one non-cyclic amide.

Softness of a paper product, such as a tissue or towel, is a desirable attribute. Softness, like strength and absorbency, plays a key role in consumer preference. Softness relates both to the product bulk and surface characteristics. Softness is the tactile sensation perceived by a user when they touch and hold the paper product.

Paper is generally manufactured by suspending cellulosic fibers of appropriate length in an aqueous medium and then removing most of the water from the web. The paper derives some of its structural integrity from the mechanical arrangement of the cellulosic fibers in the web, but most, by far, of the paper's strength is derived from hydrogen bonding which links the cellulosic fibers to one another. The degree of strength imparted by this interfiber bonding, while necessary to the utility of the product, results in a lack of perceived softness that is inimical to consumer acceptance.

One method of increasing the softness of paper is by creping it. Creping, by breaking a significant number of interfiber bonds, increases the perceived softness of the resulting product. Creping is a process, which is well known in the art. Creping is the process of mechanically foreshortening a fibrous structure in the machine direction in order to enhance bulk, stretch, and softness. Creping is used to remove a fibrous web from a drying structure, such as a Yankee dryer. The fibrous web is adhered to the dryer and removed from the dryer using a flexible creping blade. The creping blade can be made of metal, ceramic, or other materials. The degree to which the web is adhered to the dryer is a factor in determining how uniform the creping will be and thus, the bulk, stretch, and softness of the creped web.

Creping aids are applied to a creping dryer surface to facilitate the adhesion/creping process. The adhesion level is important, since it relates to web control from the creping blade to the reel on a paper machine. Paper webs not sufficiently adhered to a creping dryer surface are difficult to control and can cause wrinkles and weaving of the web in the parent roll. When a web weaves at the reel the parent roll edges are uneven. Poorly creped webs not only affect the reliability of the papermaking operation but also can cause sheet breaks and difficulties in converting base sheet into finished product rolls of towel or tissue.

The level of adhesion of a web to a creping dryer surface is important, because it relates to the transfer of heat from the surface of the dryer to the web and ultimately affects the drying rate. Therefore, higher levels of adhesion allow for a web to dry faster, thus allowing the paper machine to operate at higher speeds.

A through-air-dried web tends to have poorer adhesion to a creping dryer surface than a conventionally wet pressed web. There are several reasons for this phenomenon. First, through-air-dried webs contact the surface of a creping dryer at lower contact levels since the web is transferred to the surface of the creping dryer with a limited-knuckle-area fabric, while a conventionally wet-pressed web is pressed more uniformly with a felt against the dryer surface. Second, through-air-dried webs are transferred to a creping dryer surface at higher dryness levels, while conventionally wet-pressed webs are transferred at lower dryness levels. The lower dryness level facilitates more intimate contact of the web with the dryer surface and, hence, better adhesion.

It is important that the creping adhesive package have the proper softness/flexibility to allow sheet adhesion yet allow the doctor to maintain a clean creping dryer surface. If the adhesive becomes too hard and incomplete removal of adhesive from the creping surface occurs, portions of the web may remain adhered to the creping dryer surface. When portions of the web remain adhered to the creping dryer, defects often result in the web, which ultimately can lead to poor quality products and breaks in the web in the open draw between the creping doctor and reel.

Excessive build-up of creping adhesive on the creping dryer surface is another problem associated with the use of creping adhesive materials. Excessive build-up of creping adhesive materials on a creping dryer surface produces streaky dryers. The streaks on the dryer impact the profile of adhesion in the cross-direction (CD)—width direction—of a paper machine, often resulting in reels with bumps or wrinkles. The usual remedy for such a situation would be to change creping blades, leading to the costly situation of waste on the paper machine and the replacement of costly creping blades. Alternatively, coating streaks can be controlled through the use of a cleaning blade, which is positioned right after the creping blade on a creping dryer. The cleaning blade also has to be frequently changed to control streaks and excessive adhesive build-up.

In order to prevent adhesive build-up, creping adhesives need to provide proper levels of tack, yet be soft enough to be removed by the creping blade. The present invention discloses a modified creping adhesive package that provides the proper levels of tack, yet is soft enough to be removed by the creping blade. As a result, the creping adhesive package provides for a stable creping operation. Furthermore, the present invention discloses a modified creping adhesive which forms an improved more uniform creped paper product. The modified creping adhesive according to the present invention includes at least one quaternary ammonium complex comprising at least one non-cyclic amide. The present invention is based on the discovery that modifiers comprising a quaternary ammonium complex comprising at least one non-cyclic amide can beneficially affect the adhesive characteristics of a creping adhesive and thus, will beneficially affect the structure of the final creped web and the paper making process.

The present invention provides an improved creping adhesive that can remain softer and tackier through the addition of a creping modifier, especially for webs creped at low moisture conditions.

In accordance with the present invention, there is disclosed a creping adhesive comprising a modifier comprising a quaternary ammonium complex comprising at least one non-cyclic amide.

There is further disclosed a creping adhesive comprising an aqueous admixture of polyvinyl alcohol, a water-soluble polyamide resin, and a quaternary ammonium complex modifier comprising at least one non-cyclic amide.

There is still further disclosed a creping adhesive comprising an aqueous admixture of polyvinyl alcohol and a quaternary ammonium complex modifier comprising at least one non-cyclic amide.

There is also disclosed a creping adhesive comprising an aqueous admixture of a water-soluble polyamide resin and a quaternary ammonium complex modifier comprising at least one non-cyclic amide.

There is disclosed a method for making a cellulosic web comprising forming a nascent web on a foraminous fabric; applying to a rotating creping cylinder a creping adhesive comprising a modifier comprising a quaternary ammonium complex comprising at least one non-cyclic amide; and pressing the cellulosic web against the creping cylinder to cause sheet transfer and adhesion of the web to the cylinder surface.

There is further disclosed a method for making a cellulosic web comprising forming a nascent web foraminous applying rotating creping cylinder a creping adhesive comprising an aqueous admixture of polyvinyl alcohol, a water-soluble polyamide resin, and a quaternary ammonium complex modifier comprising at least one non-cyclic amide; and pressing the cellulosic web against the creping cylinder to cause sheet transfer and adhesion of the web to the cylinder surface.

There is still further disclosed a method for making a cellulosic web comprising forming a nascent web on a foraminous fabric; applying to a rotating creping cylinder a creping adhesive comprising an aqueous admixture of polyvinyl alcohol and a quaternary ammonium complex modifier comprising at least one non-cyclic amide; and pressing the cellulosic web against the creping cylinder to cause sheet transfer and adhesion of the web to the cylinder surface.

There is also disclosed a method for making a cellulosic web comprising forming a nascent web on a foraminous fabric; applying to a rotating creping cylinder a creping adhesive comprising an aqueous admixture of a water-soluble polyamide resin and a quaternary ammonium complex modifier comprising at least one non-cyclic amide; and pressing the cellulosic web against the creping cylinder to cause sheet transfer and adhesion of the web to the cylinder surface.

There is disclosed a method for making a cellulosic web comprising forming a nascent web on a foraminous fabric; transferring the nascent web from one foraminous fabric to another foraminous through-air-drying fabric; partially drying the web to a solids level of from about 40% solids to about 98% solids on said through-air-dryer fabric; applying to a rotating creping cylinder a creping adhesive comprising a modifier comprising a quaternary ammonium complex comprising at least one non-cyclic amide; and pressing the cellulosic web against the creping cylinder to cause sheet transfer and adhesion of the web to the cylinder surface.

There is further disclosed a method for making a cellulosic web comprising forming a nascent web on a foraminous fabric; transferring the nascent web from one foraminous fabric to another foraminous through-air-drying fabric; partially drying the web to a solids level of from about 40% solids to about 98% solids on the through-air-drying fabric; applying to a rotating creping cylinder a creping adhesive comprising an aqueous admixture of polyvinyl alcohol, a water-soluble polyamide resin and a quaternary ammonium complex modifier comprising at least one non-cyclic amide; and pressing the cellulosic web against the creping cylinder to cause sheet transfer and adhesion of the web to the cylinder surface.

There is still further disclosed a method for making a cellulosic web comprising forming a nascent web on a foraminous fabric; transferring the nascent web from one foraminous fabric to another foraminous through-air-drying fabric; partially drying the web to a solids level of from about 40% solids to about 98% solids on the through-air-drying fabric; applying to a rotating creping cylinder a creping adhesive comprising an aqueous admixture of polyvinyl alcohol and a quaternary ammonium complex modifier comprising at least one non-cyclic amide; and pressing the cellulosic web against the creping cylinder to cause sheet transfer and adhesion of the web to the cylinder surface.

There is also disclosed a method for making a cellulosic web comprising forming a nascent web on a foraminous fabric; transferring the nascent web from one foraminous fabric to another foraminous through-air-drying fabric; partially drying the web to a solids level of from about 40% solids to about 98% solids on the through-air-drying fabric; applying to a rotating creping cylinder a creping adhesive comprising an aqueous admixture of a water-soluble polyamide resin and a quaternary ammonium complex modifier comprising at least one non-cyclic amide; and pressing the cellulosic web against the creping cylinder to cause sheet transfer and adhesion of the web to the cylinder surface.

There is disclosed a method for creping a cellulosic web comprising forming a nascent web from an aqueous fiber furnish on a foraminous fabric; transferring the nascent web from one foraminous fabric to another foraminous through-air-drying fabric at a fabric crepe level from about 0% to about 25%; partially drying the web to a solids level of from about 40% solids to about 98% solids on the through-air-drying fabric; applying to a rotating creping cylinder a creping adhesive comprising an aqueous admixture of polyvinyl alcohol, a water-soluble polyamide resin and a quaternary ammonium complex modifier comprising at least one non-cyclic amide; pressing the cellulosic web against the creping cylinder to cause sheet transfer from the foraminous through-air-drying fabric and adhesion of the web to the cylinder surface; drying the cellulosic web on the creping cylinder to from about 92% solids to about 99% solids; removing the web from the creping cylinder surface with a doctor blade with residual creping of from about −7% to about 30%; and wrapping the web into a reel.

There is further disclosed a method for creping a cellulosic web comprising forming a nascent web from an aqueous fiber furnish on a foraminous fabric; transferring the nascent web from one foraminous fabric to another foraminous through-air-drying fabric at a fabric crepe level from about 0% to about 25%; partially drying the web to a solids level of from about 40% solids to about 98% solids on said through-air-drying fabric; applying to a rotating creping cylinder a creping adhesive comprising an aqueous admixture of polyvinyl alcohol, a water-soluble polyamide resin, at least one zirconium salt and a quaternary ammonium complex modifier comprising at least one non-cyclic amide; pressing the cellulosic web against the creping cylinder to cause sheet transfer from the foraminous through-air-drying fabric and adhesion of the web to the cylinder surface; drying the cellulosic web on the creping cylinder to from about 92% solids to about 99% solids; removing the web from the creping cylinder surface with a doctor blade with a residual crepe level of from about −7% to about 30%; and wrapping the web into a reel.

There is still further disclosed a paper product produced by applying to a creping cylinder a creping adhesive comprising a modifier comprising a quaternary ammonium complex comprising at least one non-cyclic amide, creping a fibrous web from the creping cylinder and producing said paper product from said fibrous web.

Finally, there is disclosed a paper product produced by applying to a creping cylinder a creping adhesive comprising an aqueous admixture of polyvinyl alcohol, a water-soluble polyamide resin and a quaternary ammonium complex modifier comprising at least one non-cyclic amide; creping a fibrous web from the creping cylinder; and producing said paper product from said fibrous web.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DETAILED DESCRIPTION OF THE INVENTION

The present invention provides absorbent paper web properties and paper machine runnability through the use of a creping adhesive modifier. An absorbent paper web as defined herein includes bath tissue, paper towels, paper napkins, wipers, and facial tissue. The basis weight of such products and their base sheets are in the range of about 8 lb/3000 $ft^2$ to about 50 lb/3000 $ft^2$.

Figure 1:
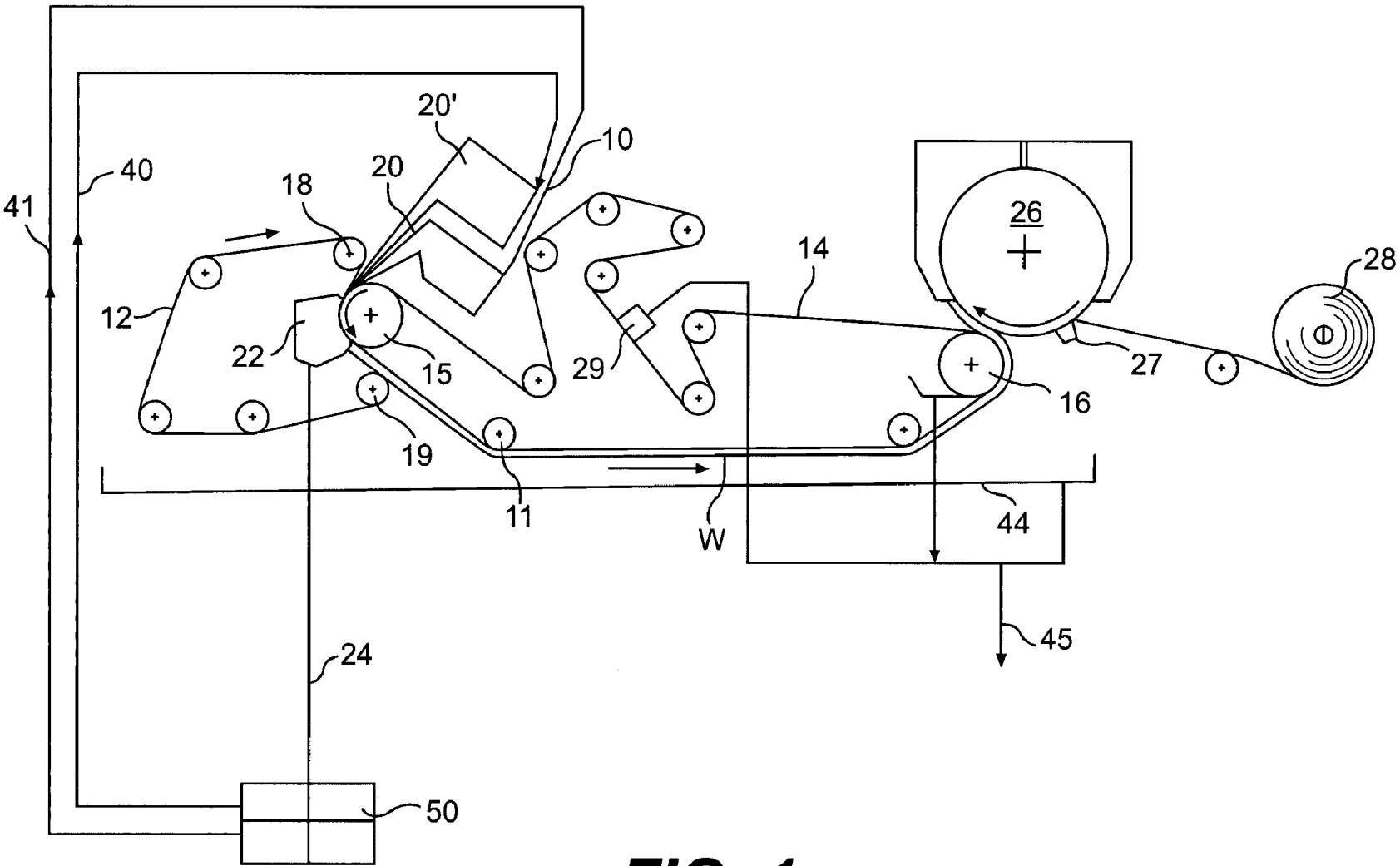
FIG. 1 is an illustration of a conventional wet press process.

According to the present invention, absorbent paper may be produced using any known method of drying. The most common drying methods are (I) conventional wet pressing (CWP) and (II) through-air-drying (TAD). In a conventional wet press process and apparatus (10), as exemplified in FIG. 1, a furnish is fed from a stuffbox (not shown) into conduits (40, 41) to headbox chambers (20, 20'). A web (W) is formed on a conventional wire former (12), supported by rolls (18, 19), from liquid slurry of pulp, water and other chemicals. Materials removed from the web through fabric (12) in the forming zone are returned to silo (50), from saveall (22) through conduit (24). The web is then transferred to a moving felt or fabric (14), supported by roll (11) for drying and pressing. Materials removed from the web during pressing or from the Uhle box (29) are collected in saveall (44) and fed to white water conduit (45). The web is then pressed by suction press roll (16) against the surface of a rotating Yankee dryer cylinder (26), which is heated to cause the paper to substantially dry on the cylinder surface. Although not shown in FIG. 1, a shoe press could be used in place of the suction press roll to press the paper against the surface of a rotating Yankee dryer cylinder (26). The moisture within the web as it is laid on the Yankee surface causes the web to transfer to the surface. Sheet dryness levels immediately after the suction press roll are in the range of about 30% to about 50% dryness. Liquid adhesive, often referred to as creping adhesive, may be applied to the surface of the dryer to provide substantial adherence of the web to the creping surface. The web is then creped from the surface with a creping blade (27) or a roller equipped with a fabric. Details of roll creping are generally described in U.S. Pat. Nos. 5,223,092 and 5,314,584, which are incorporated herein by reference. The creped web is then optionally passed between calender rollers (not shown) and rolled up on roll (28) prior to further converting operations, for example, embossing.

A web may alternatively be subjected to vacuum deformation on an impression fabric, alone or in conjunction with other physical deformation processes, and a drying step, which dries the web to a solids content of at least about 30% without the need for overall physical compression. This type of process is conventionally referred to as a through-air-drying process or TAD process. This process is generally described in U.S. Pat. Nos. 3,301,746, to Sanford et al. and 3,905,863, to Ayers, which are incorporated herein by reference.

Figure 2:
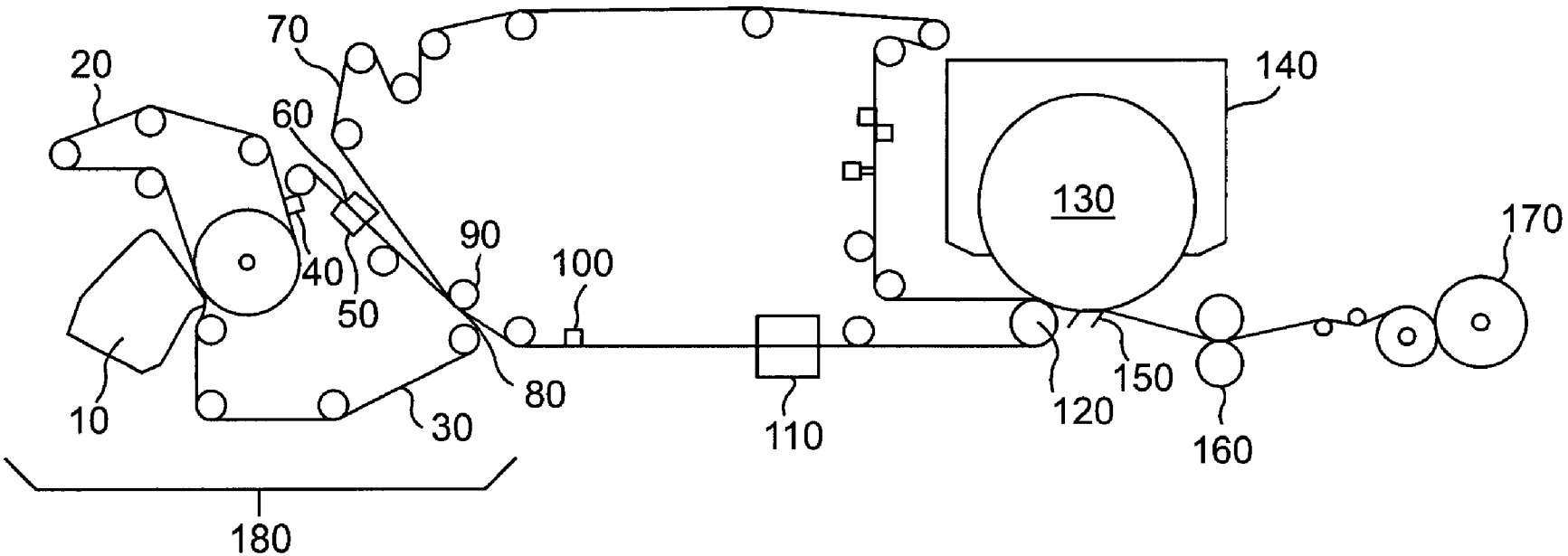
FIG. 2 is an illustration of a conventional through-air-drying process.

As an example, one conventional TAD process is illustrated in FIG. 2. In this process, fibers are fed from a headbox (10) to a converging set of forming wires (20,30). In this twin wire forming arrangement water is removed from the web by centrifugal forces and by vacuum means. The wet nascent web is cleanly transferred to forming wire (30) via Uhle box (40). The web can be optionally processed to remove water by vacuum box (50) and steam shroud (60). The web is carried along forming fabric (30) until it is transferred to a TAD fabric (70) at junction (80) by means of a vacuum pickup shoe (90). The web is further dewatered at dewatering box (100) to increase web solids. Besides removing water from the web, vacuum pickup shoe (90) and dewatering box (100) inundate the web into the TAD fabric (70) causing bulk and absorbency characteristics.

Further enhancements in bulk and absorbency can be obtained by operating the speed of the forming section (i.e., the speeds of forming fabrics 20 and 30) faster than the speed of TAD fabric (70). This is referred to as fabric creping. Fabric creping is defined mathematically as the difference in speed between the former and the through-air-dryer divided by the speed of the through-air-dryer expressed as a percentage. In this manner, the web is inundated and wet shaped into the fabric creating bulk and absorbency. The amount of fabric crepe may be from 0% to about 25%. Thickness created by wet shaping is more effective in generating absorbency (i.e. less structural collapse) than thickness created in the dry state, e.g., by conventional embossing.

The web is then carried on the TAD fabric (70) to a drying unit (110) where heated air is passed through both the web and the fabric to increase the solids content of the web. Generally, the web is 30 to 95% dry after exiting drying unit (110). In one process, the web may be removed directly from the TAD fabric (70) in an uncreped process. In the embodiment shown in FIG. 2, the web is transferred from the TAD fabric (70) to Yankee dryer cylinder (130) and is creped from the dryer cylinder (130) via creping blade (150), thus producing a creped product.

With reference to FIG. 2, the creping adhesive is applied to the Yankee dryer surface to provide substantial adhesion of the web to the creping surface. The web is then creped from the surface with a creping blade (150). The creped web is then optionally passed between calender rollers (160) and rolled up on roll (170) prior to further converting operations, (for example, embossing). Speed of the reel can be faster or slower than the speed of the Yankee dryer. The level of creping is defined as the speed difference between the Yankee and the reel divided by the Yankee speed expressed as a percentage. The action of the creping blade on the paper is known to cause a portion of the interfiber bonds within the paper to be broken up by the mechanical smashing action of the blade against the web as it is being driven into the blade. However, fairly strong interfiber bonds are formed between wood pulp fibers during the drying of moisture from the web.

According to the present invention, an absorbent paper web can be made by dispersing fibers into aqueous slurry and depositing the aqueous slurry onto the forming wire of a papermaking machine. Any art recognized forming scheme might be used. For example, an extensive but non-exhaustive, list includes a crescent former, a C-wrap twin-wire former, an S-wrap twin wire former, a suction breast roll former, a fourdrinier former, or any other art recognized forming configuration. The particular forming apparatus is not critical to the success of the present invention. The web can be homogenously formed or stratified. When homogenously forming a web, the stock in the various headbox chambers is uniform. When forming a web by stratification, the stock in the various headbox chambers is of different composition. The forming fabric can be any art recognized foraminous member including single layer fabrics, double layer fabrics, triple layer fabrics, photopolymer fabrics, and the like. A non-exhaustive list of forming fabrics for use in the present invention include U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,467; 5,211,815; 5,219,004; 5,245,025; 5,277,761; 5,328,565; and 5,379,808, all of which are incorporated herein by reference. The particular forming fabric is not critical to the success of the present invention. One forming fabric found particularly useful with the present invention is Voith made by Voith Fabric Corporation, Florence, Miss.

The papermaking fibers used to form the web include cellulosic fibers commonly referred to as wood pulp fibers, liberated in a chemical or mechanical pulping process from softwood (gymnosperms or coniferous trees) and hardwoods (angiosperms or deciduous trees). The particular tree and pulping process used to liberate the tracheid are not critical to the success of the present invention.

Cellulosic fibers from diverse material origins may be used to form the web of the present invention, including non-woody fibers liberated from sabai grass, rice straw, banana leaves, paper mulberry (i.e. bast fiber), abaca leaves, pineapple leaves, esparto grass leaves, and fibers from the genus hesperalae in the family agavaceae. Also recycled fibers and refined fibers, which may contain any of the above fiber sources in different percentages, can be used in the present invention. Other natural and synthetic fibers such as cotton fibers, wool fibers and bi-component fibers can be used in the present invention. The particular fiber used is not critical to the success of the present invention.

Papermaking fibers can be liberated from their source material by any one of the number of chemical pulping processes familiar to the skilled artisan including sulfate, sulfite, polysulfite, soda pulping, etc. Furthermore, papermaking fibers can be liberated from source material by any one of a number of mechanical/chemical pulping processes familiar to anyone experienced in the art including mechanical pulping, thermo-mechanical pulping, and chemi-thermo-mechanical pulping. The pulp can be bleached, if desired, by chemical means including the use of chlorine, chlorine dioxide, oxygen, etc. These pulps can also be bleached by a number of familiar bleaching schemes including alkaline peroxide and ozone bleaching.

The slurry of fibers may contain additional treating agents or additives to alter the physical properties of the paper product produced. These additives and agents are well understood by the skilled artisan and may be used in any known combination. Because strength and softness are particularly important properties for paper napkins, bath tissue, and paper towels, the pulp can be mixed with strength adjusting agents, such as wet strength agents, temporary wet strength agents, dry strength agents and debonders/softeners.

Suitable wet strength agents will be readily apparent to the skilled artisan. A comprehensive but non-exhaustive list of useful wet strength aids include aliphatic and aromatic aldehydes, urea-formaldehyde resins, melamine formaldehyde resins, polyamide-epichlorohydrin resins, and the like. Of particular utility are the polyamide-epichlorohydrin resins, examples of which are sold under the trade names KYMENE 557LX and KYMENE 557H, by Hercules Incorporated of Wilmington, Del. These resins and the process for making them are described in U.S. Pat. No. 3,700,623 and U.S. Pat. No. 3,772,076, each of which is incorporated herein by reference in their entirety. An extensive description of polymeric-epihalohydrin resins is given in Chapter 2: *Alkaline-Curing Polymeric Amine-Epichlorohydrin Resins* by Espy in *Wet-Strength Resins and Their Application* (L. Chan, Editor, 1994), herein incorporated by reference in its entirety. A non-exhaustive list of wet strength resins is described by Wesffelt in *Cellulose Chemistry and Technology*, Volume 13, p. 813, 1979, which is incorporated herein by reference. According to one embodiment, the pulp may contain up to about 30 lbs/ton of wet strength agent. According to another embodiment of the invention, the pulp may contain from about 20 to about 30 lbs/ton of a wet strength agent.

Suitable temporary wet strength agents will be readily apparent to the skilled artisan. A comprehensive but non-exhaustive list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers can impart a positive charge to the aldehyde containing reaction product. In addition, other commercially available temporary wet strength agents, such as, PAREZ 745, manufactured by Cytec can be used, along with those disclosed, for example in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus, by National Starch and Chemical Company of Bridgewater, N.J. may be used. Prior to use, the cationic aldehydic water soluble polymer can be prepared by preheating an aqueous slurry of approximately 5% solids maintained at a temperature of approximately 240 degrees Fahrenheit and a pH of about 2.7 for approximately 3.5 minutes. Finally, the slurry can be quenched and diluted by adding water to produce a mixture of approximately 1.0% solids at less than about 130 degrees Fahrenheit.

Other temporary wet strength agents, also available from National Starch and Chemical Company are sold under the trademarks CO-BOND® 1600 and CO-BOND® 2300. These starches are supplied as aqueous colloidal dispersions and do not require preheating prior to use.

Temporary wet strength agents such as glyoxylated polyacrylamide can be used. Temporary wet strength agents such as glyoxylated polyacrylamide resins are produced by reacting acrylamide with diallyl dimethyl ammonium chloride (DADMAC) to produce a cationic polyacrylamide copolymer which is ultimately reacted with glyoxal to produce a cationic cross-linking temporary or semi-permanent wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference. Resins of this type are commercially available under the trade name of PAREZ 631NC, by Cytec Industries. Different mole ratios of acrylamide/DADMAC/glyoxal can be used to produce cross-linking resins, which are useful as wet strength agents. Furthermore, other dialdehydes can be substituted for glyoxal to produce wet strength characteristics.

According to one embodiment, the pulp may contain up to about 30 lbs/ton of a temporary wet strength agent. According to another embodiment, the pulp may contain from about 0 to about 10 lbs/ton of a temporary wet strength agent.

Suitable dry strength agents will be readily apparent to one skilled in the art. A comprehensive but non-exhaustive list of useful dry strength agents include starch, guar gum, polyacrylamides, carboxymethyl cellulose and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton of dry strength agent. According to another embodiment, the pulp may contain from about 1 to about 5 lbs/ton of dry strength agent.

Suitable debonders and softeners will also be readily apparent to the skilled artisan. These debonders and softeners may be incorporated into the pulp or sprayed upon the web after its formation. According to one embodiment of the invention, softening and debonding agents are added in an amount of not greater than about 2.0%, by weight. According to another embodiment, softening and debonding agents are added in an amount not greater than about 1.0%. According to yet another embodiment, the softening and debonding agents are added in an amount between about 0% and about 0.4%, by weight.

One preferred softener material is an amido amine salt derived from partially acid neutralized amines. Such materials are disclosed in U.S. Pat. No. 4,720,383. Also relevant are the following articles: Evans, Chemistry and Industry, 5 Jul. 1969, pp. 893-903; Egan, J. Am. Oil Chemist's Soc., Vol. 55 (1978), pp. 118-121; and Trivedi et al., J. Am. Oil Chemist's Soc., June 1981, pp. 754-756. All of the above articles are herein incorporated by reference.

Softeners are often available commercially as complex mixtures rather than as single compounds. While this discussion will focus on the predominant species, it should be understood that commercially available mixtures could generally be used.

QUASOFT 202 is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. The selection of appropriate system pH(s) for the use of these compounds will be readily apparent to the skilled artisan.

Quaternary ammonium compounds, such as dialkyl dimethyl quaternary ammonium salts are also suitable particularly when the alkyl groups contain from about 14 to 20 carbon atoms. These compounds have the advantage of being relatively insensitive to pH.

The present invention can also be used with a class of cationic softeners comprising imidazolines which have a melting point of about 0° to about 40° C. when formulated with aliphatic polyols, aliphatic diols, alkoxylated aliphatic diols, alkoxylated aliphatic polyols, alkoxylated fatty acids, or a mixture of these compounds. The softener comprising an imidazoline moiety formulated with aliphatic polyols, aliphatic diols, alkoxylated aliphatic diols, alkoxylated aliphatic polyols, alkoxylated fatty acids, or a mixture of these compounds is dispersible in water at a temperature of about 1° C. to about 40° C.

The imidazolinium moiety has the following chemical structure;

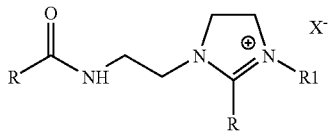

and, the imidazoline has the following structure:

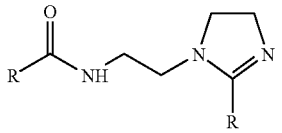

wherein $X^-$ is an anion and R is chosen from saturated and unsaturated paraffinic moieties having a carbon chain length of $C_{12}$ to $C_{20}$. According to one embodiment, the carbon chain length is $C_{16}$-$C_{20}$. $R_1$ is chosen from paraffinic moieties having a carbon chain length of $C_1$-$C_3$. Suitably the anion can be methyl sulfate, ethyl sulfate, or chloride.

The organic compound component of the softener, other than the imidazolinium and imidazoline species, can be chosen from aliphatic diols, alkoxylated aliphatic diols, aliphatic polyols, alkoxylated aliphatic polyols, alkoxylated fatty acids, esters of polyethylene oxides, or a mixture of these compounds having a weight average molecular weight of about 60 to about 1500. According to one embodiment of the invention, the cold-water dispersed aliphatic diols can have a molecular weight of about 90 to about 150. According to another embodiment of the invention, the cold water dispersed aliphatic diols can have a molecular weight of about 106 to about 150. Suitable diols for use according to one embodiment of the invention are chosen from one or more of 2,2,4-trimethyl 1,3-pentane diol (TMPD) and ethoxylated 2,2,4-trimethyl 1,3-pentane diol (TMPD/EO). Suitably, the alkoxylated diol is TMPD $(EO)_n$ wherein n is an integer from 1 to 7, inclusive. Dispersants for the imidazolinium and imidazoline species are alkoxylated aliphatic diols and alkoxylated polyols. Since it is hard to obtain pure alkoxylated diols and alkoxylated polyols, mixtures of diols, polyols, and alkoxylated diols, and alkoxylated polyols, and mixtures of only diols and polyols can be suitably utilized. A suitable imidazolinium based softener is sold by Hercules, under the trade name Hercules TQ230.

Biodegradable softeners can also be utilized. Representative biodegradable cationic softeners/debonders are disclosed in U.S. Pat. Nos. 5,312,522; 5,415,737; 5,262,007; 5,264,082; and 5,223,096, herein incorporated by reference. These compounds are biodegradable diesters of quaternary ammonium compounds, quaternized amine-esters, biodegradable vegetable oil based esters functional with quaternary ammonium chloride and diester dierucyldimethyl ammonium chloride and are representative biodegradable softeners.

Suitable additives, such as particulate fillers will be readily apparent to one skilled in the art. A comprehensive, but non-exhaustive, list of useful additives, such as particulate fillers include clay, calcium carbonate, titanium dioxide, talc, aluminium silicate, calcium silicate, calcium sulfate, and the like.

Suitable retention aids will be readily apparent to one skilled in the art. A comprehensive, but non-exhaustive, list of useful retention aids includes anionic and cationic flocculants.

Alternatively, instead of being incorporated into the pulp, these treating agents can be applied to the web. This may be accomplished through one or more applicator systems and can be to either one or both surfaces of the web. Application of multiple treating agents using multiple application systems helps to prevent chemical interaction of treating materials prior to their application to the cellulose web. Alternative configurations and application positions will be readily apparent to the skilled artisan.

Other additives that may be present in the fibrous slurry include sizing agents, absorbency aids, opacifiers, brightners, optical whiteners, barrier chemistries, lotions, dyes, or colorants.

After deposition of the fibrous slurry onto the forming wire, the thus-formed wet fibrous web is transferred onto a dewatering felt or an impression fabric, which can create a pattern in the web, if desired. Any art-recognized fabrics or felts can be used with the present invention. For example, a non-exhaustive list of impression fabrics includes plain weave fabrics described in U.S. Pat. No. 3,301,746; semi-twill fabrics described in U.S. Pat. Nos. 3,974,025 and 3,905,863; bilaterally-staggered-wicker-basket-cavity type fabrics described in U.S. Pat. Nos. 4,239,065 and 4,191,609; sculptured/load bearing layer type fabrics described in U.S. Pat. No. 5,429,686; photopolymer fabrics described in U.S. Pat. Nos. 4,529,480; 4,637,859; 4,514,345; 4,528,339; 5,364,504; 5,334,289; 5,275,799; and 5,260,171; and fabrics containing diagonal pockets described in U.S. Pat. No. 5,456,293. The aforementioned patents are incorporated herein by reference.

Any art-recognized-felt can be used with the present invention. For example, felts can have double-layer base weaves, triple-layer base weaves, or laminated base weaves. One press-felt for use with the present invention is AMFlex 3, made by Voith Fabric Corportation. A non-exhaustive list of press felts for use in the present invention includes U.S. Pat. Nos. 5,657,797; 5,368,696; 4,973,512; 5,023,132; 5,225,269; 5,182,164; 5,372,876; and 5,618,612, all of which are incorporated herein by reference.

After transfer, the web, at some point, is passed through the dryer section, which causes substantial drying of the web. As described above, the web can be dried using conventional wet-pressing techniques, or may be produced using through-air-drying (TAD). If produced using TAD, the web may be pressed to the surface of a rotating Yankee dryer cylinder to remove additional moisture within the web. Other suitable processes include wet creping or through-air-drying with wet creping. Any type of creping blade may be used, including, but not limited to steel blades; ceramic blades; biaxially undulatory blades, as described, for example, in U.S. Pat. Nos. 5,685,954, 5,885,417, and 5,908,533; and the creping blades as described in U.S. Pat. No. 6,066,234, each of which is incorporated herein by reference.

Creping adhesives of the present invention comprise a creping modifier and may comprise a thermosetting or non-thermosetting resin, a film-forming semi-crystalline polymer and an inorganic cross-linking agent. Optionally, the creping adhesive of the present invention may also include any art-recognized components, including, but not limited to, organic cross-linkers, hydrocarbons oils, surfactants, or plasticizers.

Creping modifiers for use according to the present invention comprise any art-recognized quaternary ammonium complex comprising at least one non-cyclic amide. The quaternary ammonium compound may also contain one or several nitrogen atoms (or other atoms) that are capable of reacting with alkylating or quaternizing agents. These alkylating or quaternizing agents may contain zero, one, two, three or four non-cyclic amide containing groups. A non-cyclic amide containing group is represented by the following formula structure:

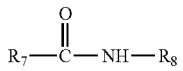

where $R_7$ and $R_8$ are non-cyclic molecular chains of organic atoms or organic and inorganic atoms.

Creping modifiers according to the present invention comprise any quaternary ammonium complex comprising at least one non-cyclic amide, which can interact with the creping adhesive to improve the adhesive, e.g., reduce the brittleness of the polymer. Creping modifiers for the present invention can include one or more non-cyclic bis-amide quaternary ammonium complexes. Non-cyclic bis-amide quaternary ammonium complexes according to the present invention can be of the formula:

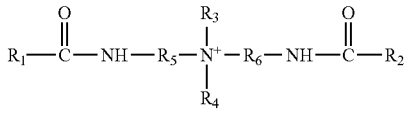

where $R_1$ and $R_2$ can be long chain non-cyclic saturated or unsaturated aliphatic groups; $R_3$ and $R_4$ can be long chain non-cyclic saturated or unsaturated aliphatic groups, an alkoxylated fatty acid, an alkoxylated fatty alcohol, a polyethylene oxide group, or an organic alcohol group; and $R_5$ and $R_6$ can be long chain non-cyclic saturated or unsaturated aliphatic groups. According to one embodiment, the modifier is present in the creping adhesive according to the present invention in an amount of from about 0.05% to about 50%. According to another embodiment, the modifier is present in the creping adhesive in an amount of from about 0.25% to about 20%. According to yet another embodiment, the modifier is present in the creping adhesive in an amount of from about 1% to about 18% based on the total solids of the creping adhesive composition.

Creping modifiers for use according to the present invention include those obtainable from Goldschmidt Corporation of Essen/Germany or Process Application Corporation based in Washington Crossing, Pa. Appropriate creping modifiers from Goldschmidt Corporation include, but are not limited to, VARISOFT® 222LM, VARISOFT® 222, VARISOFT® 110, VARISOFT® 222LT, VARISOFT® 110 DEG, and VARISOFT® 238. Appropriate creping modifiers from Process Application Corporation include, but are not limited to, PALSOFT 580 or PALSOFT 580C.

Other creping modifiers for use in the present invention include, but are not limited to, those compounds as described in WO/01/85109 (related to U.S. Pat. No. 6,458,343), which is incorporated by reference herein in its entirety.

Creping adhesives for use according to the present invention include any art-recognized thermosetting or non-thermosetting resin. Resins according to one embodiment of the present invention are chosen from thermosetting and non-thermosetting polyamide resins or glyoxylated polyacrylamide resins. Polyamides for use in the present invention can be branched or unbranched, saturated or unsaturated.

Polyamide resins for use in the present invention may include polyaminamide-epichlorohydrin (PAE) resins. PAE resins are described, for example, in "Wet-Strength Resins and Their Applications," Ch. 2, H. Epsy entitled Alkaline-Curing Polymeric Amine-Epichlorohydrin Resins, which is incorporated herein by reference in its entirety. PAE resins for use according to the present invention include, but are not limited to, a water-soluble polymeric reaction product of an epihalohydrin, preferably epichlorohydrin, and a water-soluble polyaminamide having secondary amine groups derived from a polyalkylene polyamine and a saturated aliphatic dibasic carboxylic acid containing from about 3 to about 10 carbon atoms.

A non-exhaustive list of non-thermosetting cationic polyamide resins for use in the present invention can be found in U.S. Pat. No. 5,338,807, issued to Espy et al. and incorporated herein by reference. The non-thermosetting resin may be synthesized by directly reacting the polyamides of a dicarboxylic acid and methyl bis(3-aminopropyl)amine in an aqueous solution, with epichlorohydrin. The carboxylic acids can include saturated and unsaturated dicarboxylic acids having from about 2 to 12 carbon atoms, including for example, oxalic, malonic, succinic, glutaric, adipic, pilemic, suberic, azelaic, sebacic, maleic, itaconic, phthalic, and terephthalic acids. According to one embodiment of the invention, the acid is chosen from one or more of adipic and glutaric acids. The esters of the aliphatic dicarboxylic acids and aromatic dicarboxylic acids, such as the phathalic acid, may be used, as well as combinations of such dicarboxylic acids or esters.

In an alternative embodiment, thermosetting polyaminamide resins for use in the present invention may be made from the reaction product of an epihalohydrin resin and a polyaminamide containing secondary amine or tertiary amines. In the preparation of a resin according to this embodiment of the invention, a dibasic carboxylic acid is first reacted with the polyalkylene polyamine, optionally in aqueous solution, under conditions suitable to produce a water-soluble polyaminamide. The preparation of the resin is completed by reacting the water-soluble amide with an epihalohydrin, particularly epichlorohydrin, to form the water-soluble thermosetting resin.

The method of preparation of water soluble, thermosetting polyaminamide-epihalohydrin resin is described in U.S. Pat. Nos. 2,926,116; 3,058,873; and 3,772,076 issued to Kiem, all of which are incorporated herein by reference in their entirety.

According to one embodiment of the present invention, the polyaminamide resin is based on DETA instead of a generalized polyamine. Two examples of structures of such a polyaminamide resin are given below.

Structure 1 shows two types of end groups: a di-acid and a mono-acid based group:

STRUCTURE 1

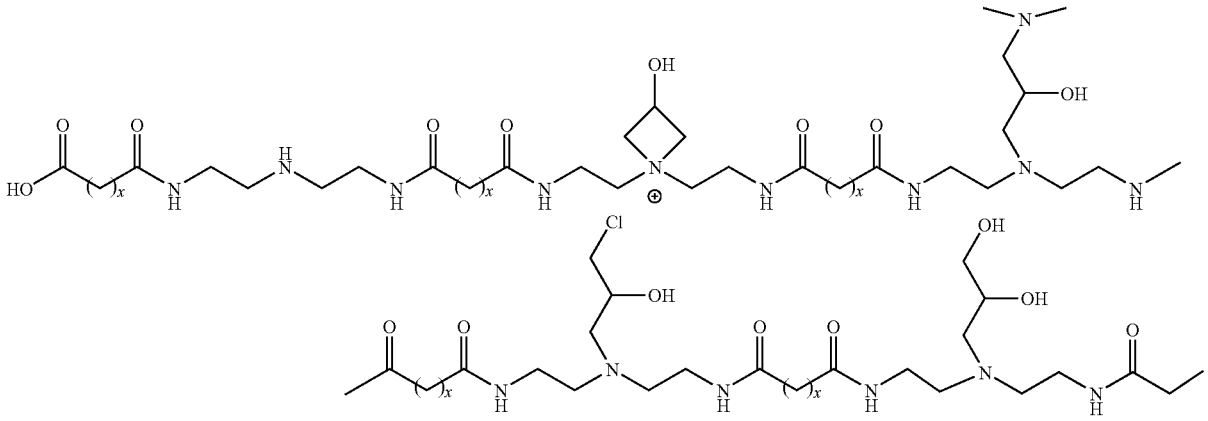

Structure 2 shows a polymer with one end-group based on a di-acid group and the other end-group based on a nitrogen containing group:

STRUCTURE 2

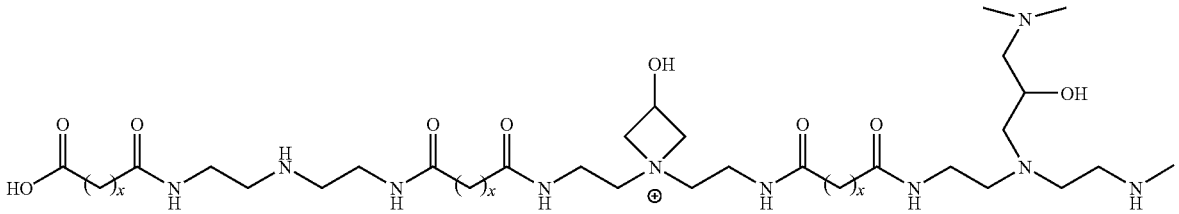

-continued

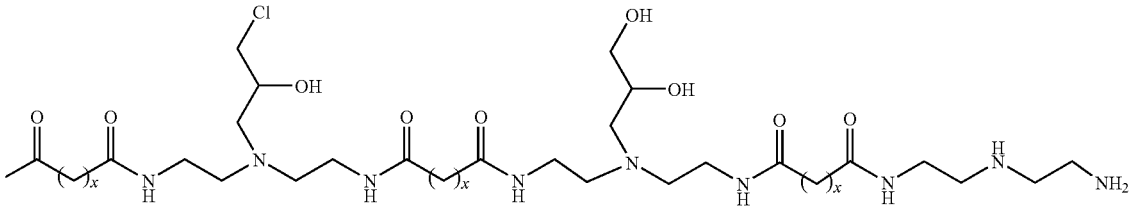

Note that although both structures are based on DETA, other polyamines may be used to form this polymer, including those, which may have tertiary amide side chains.

The polyaminamide resin has a viscosity of from about 80 to about 800 centipoise and a total solids of from about 5% to about 40%. According to one embodiment, the polyaminamide resin is present in the creping adhesive according to the present invention in an amount of from about 0% to about 99.5%. According to another embodiment, the polyaminamide resin is present in the creping adhesive in an amount of from about 20% to about 80%. In yet another embodiment, the polyaminamide resin is present in the creping adhesive in an amount of from about 40% to about 60% based on the total solids of the creping adhesive composition.

Polyaminamide resins for use according to the present invention can be obtained from Ondeo-Nalco Corporation, based in Naperville, Ill., and Hercules Corporation, based in Wilmington, Del. Creping adhesive resins for use according to the present invention from Ondeo-Nalco Corporation include, but are not limited to, CREPECCEL® 675NT, CREPECCEL® 675P and CREPECCEL® 690HA. Appropriate creping adhesive resins available from Hercules Corporation include, but are not limited to, HERCULES 82-176, Unisoft 805 and CREPETROL A-6115.

Other polyaminamide resins for use according to the present invention include, for example, those described in U.S. Pat. Nos. 5,961,782 and 6,133,405, both of which are incorporated herein by reference.

The creping adhesive according to the present invention may also comprise a film-forming semi-crystalline polymer. Film-forming semi-crystalline polymers for use in the present invention can be chosen from, for example, hemicellulose, carboxymethyl cellulose, and polyvinyl alcohol (PVOH). Polyvinyl alcohols according to the present invention can have an average molecular weight of about 13,000 to about 124,000 daltons. According to one embodiment of the present invention polyvinyl alcohols have a degree of hydrolysis of from about 80% to about 99.9%. According to another embodiment, polyvinyl alcohols have a degree of hydrolysis of from about 85% to about 95%. In yet another embodiment, polyvinyl alcohols have a degree of hydrolysis of from about 86% to about 90%. Also, according to one embodiment, polyvinyl alcohols according to the present invention may have a viscosity, measured at 20 degree centigrade using a 4% aqueous solution, of from about 2 to about 100 centipoise. According to another embodiment, polyvinyl alcohols have a viscosity of from about 10 to about 70 centipoise. In yet another embodiment, polyvinyl alcohols have a viscosity of from about 20 to about 50 centipoise.

According to one embodiment, the polyvinyl alcohol is present in the creping adhesive in an amount of from about 0% to about 99.5%. According to another embodiment, the polyvinyl alcohol is present in the creping adhesive in an amount of from about 20% to about 80%. In yet another embodiment, the polyvinyl alcohol is present in the creping adhesive in an amount of from about 40% to about 60%, by weight, based on the total solids of the creping adhesive composition.

Polyvinyl alcohols for use according to the present invention include those obtainable from Monsanto Chemical Co. and Celanse Chemical. Appropriate polyvinyl alcohols from Monsanto Chemical Co. include Gelvatols, including, but not limited to, GELVATOL 1-90, GELVATOL 3-60, GELVATOL 20-30, GELVATOL 1-30, GELVATOL 20-90, and GELVATOL 20-60. Regarding the Gelvatols, the first number indicates the percentage residual polyvinyl acetate and the next series of digits when multiplied by 1,000 gives the number corresponding to the average molecular weight.

Celanese Chemical polyvinyl alcohol products for use according to the present invention (previously named Airvol products from Air Products until October 2000) are listed below:

| Grade | % Hydrolysis, | Viscosity, cps[1] | pH[2] | Volatiles, % Max. | Ash, % Max.[3] |
|---|---|---|---|---|---|
| Super Hydrolyzed | | | | | |
| Celvol 125 | 99.3+ | 28-32 | 5.5-7.5 | 5 | 1.2 |
| Celvol 165 | 99.3+ | 62-72 | 5.5-7.5 | 5 | 1.2 |
| Fully Hydrolyzed | | | | | |
| Celvol 103 | 98.0-98.8 | 3.5-4.5 | 5.0-7.0 | 5 | 1.2 |
| Celvol 305 | 98.0-98.8 | 4.5-5.5 | 5.0-7.0 | 5 | 1.2 |
| Celvol 107 | 98.0-98.8 | 5.5-6.6 | 5.0-7.0 | 5 | 1.2 |
| Celvol 310 | 98.0-98.8 | 9.0-11.0 | 5.0-7.0 | 5 | 1.2 |
| Celvol 325 | 98.0-98.8 | 28.0-32.0 | 5.0-7.0 | 5 | 1.2 |
| Celvol 350 | 98.0-98.8 | 62-72 | 5.0-7.0 | 5 | 1.2 |
| Intermediate Hydrolyzed | | | | | |
| Celvol 418 | 91.0-93.0 | 14.5-19.5 | 4.5-7.0 | 5 | 0.9 |
| Celvol 425 | 95.5-96.5 | 27-31 | 4.5-6.5 | 5 | 0.9 |
| Partially Hydrolyzed | | | | | |
| Celvol 502 | 87.0-89.0 | 3.0-3.7 | 4.5-6.5 | 5 | 0.9 |
| Celvol 203 | 87.0-89.0 | 3.5-4.5 | 4.5-6.5 | 5 | 0.9 |
| Celvol 205 | 87.0-89.0 | 5.2-6.2 | 4.5-6.5 | 5 | 0.7 |
| Celvol 513 | 86.0-89.0 | 13-15 | 4.5-6.5 | 5 | 0.7 |
| Celvol 523 | 87.0-89.0 | 23-27 | 4.0-6.0 | 5 | 0.5 |
| Celvol 540 | 87.0-89.0 | 45-55 | 4.0-6.0 | 5 | 0.5 |

[1]4% aqueous solution, 20 degrees centigrade.
[2]4% aqueous solution.
[3]As % $Na_2O$, corrected volatiles.

The creping adhesive according to the present invention may also comprise one or more inorganic cross-linking salts or agents. A non-exhaustive list of multivalent metal ions includes calcium, barium, titanium, chromium, manganese, iron, cobalt, nickel, zinc, molybdenum, tin, antimony, niobium, vanadium, tungsten, selenium, and zirconium. Mixtures of metal ions can be used. Anions appropriate for use in the present invention include, but are not limited to, acetate, formate, hydroxide, carbonate, chloride, bromide, iodide, sulfate, tartrate, and phosphate. According to one embodiment of the present invention, the inorganic cross-linking salt may be a zirconium salt. The zirconium salt for use according to one embodiment of the present invention can be chosen from one or more zirconium compounds having a valence of plus four, such as ammonium zirconium carbonate, zirconium acetylacetonate, zirconium acetate, zirconium carbonate, zirconium sulfate, zirconium phosphate, potassium zirconium carbonate, zirconium sodium phosphate, and sodium zirconium tartrate. Appropriate zirconium compounds include, for example, those described in U.S. Pat. No. 6,207,011, which is incorporated herein by reference.

According to one embodiment of the present invention, the inorganic cross-linking salt can be present in the creping adhesive in an amount of from about 0% to about 30%. In another embodiment, the inorganic cross-linking agent can be present in the creping adhesive in an amount of from about 1% to about 20%. In yet another embodiment, the inorganic cross-linking salt can be present in the creping adhesive in an amount of from about 1% to about 10% by weight based on the total solids of the creping adhesive composition. Zirconium compounds for use according to the present invention include those obtainable from EKA Chemicals Co. (previously Hopton Industries) and Magnesium Elektron, Inc. Appropriate commercial zirconium compounds from EKA Chemicals Co. are AZCOTE 5800M and KZCOTE 5000 and from Magnesium Elektron, Inc. are AZC or KZC.

Optionally, the creping adhesive according to the present invention can include any other art recognized components, including, but not limited to, organic hydrocarbon oils, surfactants, humectants, plasticizers, or other surface treatment agents. An extensive, but non-exhaustive, list of organic cross-linkers includes glyoxal, maleic anhydride, bismaleimide, bis acrylamide, and epihalohydrin. The organic cross-linkers can be cyclic or non-cyclic compounds. Plasticizers for use in the present invention can include propylene glycol, diethylene glycol, triethylene glycol, dipropylene glycol, and glycerol.

The creping adhesive according to the present invention may be applied as a single composition or may be applied in its component parts. More particularly, the polyamide resin may be applied separately from the polyvinyl alcohol (PVOH) and the modifier. In one embodiment according to the present invention, the polyamide resin, the polyvinyl alcohol, and the modifier are applied as a single composition allowing the modifier to more fully mix with the remainder of the creping adhesive. Not wishing to be bound by theory, the more well mixed the modifier with the remainder of the creping adhesive, the more uniform the effect of the modifier and the better the creping is expected to be.

EXAMPLES

Examples 1

A nascent web was formed on a twin-wire former from a 100% long fiber furnish. The furnish was stratified into three equal component streams. The outside layers contained 100% long fiber refined to a Canadian Standard Freeness (CSF) of about 550 ml. The inside layer contained 100% long fiber furnish refined to 450 CSF. The water to the head box was split equally among the stratified layers. The water rate was about 208 gallons/minute/inch of headbox width. KYMENE SLX wet strength resin was added at the machine chest stock pumps at the rate of about 23.4 lbs/ton, while CMC-7MT was added downstream of the machine chest, but before the fan pumps. CMC-7MT was added at a rate of about 3 lbs/ton.

The nascent web was conditioned with vacuum boxes and a steam shroud on the twin-wire former until it reached a nominal solids content of about 23.5%. The nascent web was transferred with vacuum assistance to a through-air drying fabric. The wet-end fabric creping level, i.e., the speed differential between the wet-end and the TAD section, expressed as a percentage of the TAD speed, was about 20%. The TAD fabric was conditioned using showers and release materials. The web was further dewatered on the TAD fabric with a vacuum box until a solids content of about 26% was achieved. The web was then dried with a through-air dryer to a solids content of about 86%.

The web was pattern pressed to the Yankee dryer at a pressure of 229 pounds per linear inch (pli). The Yankee dryer was conditioned with a creping adhesive containing about 39.4% polyvinyl alcohol, about 59.1% PAE, and about 1.5% of the creping modifier according to the present invention. The polyvinyl alcohol used was a low molecular weight (87-89% hydrolyzed) polyvinyl alcohol obtained from Air Products under the trade name AIRVOL 523. The PAE used was a 16% aqueous solution of a non-thermosetting polyaminamide copolymer of adipic acid crosslinked with epichlorohydrin and diethylenetriamine obtained from Ondeo-Nalco under the trade name NALCO 690HA. The creping modifier was a 47% 2-hydroxyethyl di-(2-alkylamidoethyl) methyl ammonium methyl sulfate and other non-cyclic alkyl and alkoxy amides and diamides containing a mixture of stearic, oleic, and linolenic alkyl groups obtained from Process Applications, Ltd., under the trade name PALSOFT 580C.

The creping adhesive was applied in an amount of 0.040 g/m$^2$. After the web was transferred to the Yankee dryer, it was dried to a solids content of about 97% using steam pressure and high velocity air hoods. The web was creped using a doctor blade and wrapped to a reel. The line load at the creping doctor and cleaning doctor was 50 pli. The creping impact angle, i.e., the angle from a tangent to the Yankee dryer to the face of the blade was 95 degrees for the creping blade and 65 degrees for the cleaning blade. The reel speed was about 3273 feet per minute (fpm). The dry-end draw, i.e., the speed differential between the Yankee and the reel, expressed as a percentage of the Yankee speed, was about −3%.

The physical properties of the base paper are given in Table 1, below. Runnability aspects are noted in Table 2, below.

Comparative Example 2

Example 2 was carried in accordance with Example 1 above, except that the Yankee dryer was conditioned with a creping adhesive which did not include a modifier. The creping adhesive contained 93% polyvinyl alcohol and 7% of a potassium polyphosphate. The polyvinyl alcohol used was in accordance with Example 1. The potassium polyphosphate was a 34% solution of potassium polyphosphate obtained from Albright and Wilson, UK, Ltd., under the tradename KALIPOL 18.

TABLE 1

| ATTRIBUTES | Example 1 | Example 2 |
|---|---|---|
| Caliper - 1 ply, mils | 18.1 | 17.7 |
| Conditional Basis Weight, lb/ream | 13.8 | 13.8 |
| DRY TENSILE STRENGTH | | |

TABLE 1-continued

| ATTRIBUTES | Example 1 | Example 2 |
|---|---|---|
| MDT, g/3" | 2585.4 | 2507.6 |
| MD Stretch, % | 28.1 | 27.2 |
| CDT, g/3" | 2134.4 | 2170.9 |
| CD, Stretch, % | 10.7 | 10.4 |
| GMDT, g/3" | 2349.1 | 2333.2 |
| WET TENSILE STRENGTH | | |
| MWDT, g/3" | 877.9 | 838.2 |
| CWDT, g/3" | 681.9 | 686.6 |
| GMWT, g/3" | 773.7 | 758.6 |
| Absorbency, $g_w/g_f$ | 14.3 | 14.3 |

TABLE 2

| Runnability Attributes | Example 1 | Example 2 |
|---|---|---|
| Breaks per hour | 0 | 4.3 |
| Creping blade changes per hour | 0 | 0.86 |
| Cleaning blade changes per hour | 0.56 | 0.86 |

It is apparent that the inventive adhesive provides equivalent sheet properties with improved runnability. The number of breaks for the comparative adhesive of the prior art was 10 breaks in a 2.33 hour run, i.e., 4.3 breaks per hour. The creping/cleaning blade had to be changed 0.86 times per hour, or twice each, during the 2.33 hour run.

With the adhesive of the present invention, the number of breaks was reduced to 0 for a 1.77 hour run time. The blade changes were reduced to a single change of the cleaning blade during the 1.77 hour run. Further, the Yankee dryer was observed to be cleaner and more efficient during operation when using the creping adhesive and modifier according to the present invention.

Examples 3-8

A nascent web was formed on a crescent former using a conventional wet press process. The fiber furnish was 70% U.S. southern hardwood and 30% U.S. southern softwood. The furnish was used in an unrefined state. Four lbs/ton of temporary wet strength resins were added to the suction side of the machine chest stock pump. The pH at the wet end was between about 5.75 and about 6.0. The Yankee speed was held constant for all runs.

The creping adhesive in Examples 3-6 included PVOH obtained from Air Products, under the trade name AIRVOL 523; a non-thermosetting PAE resin obtained from Ondeo-Nalco, under the trade name NALCO 690HA; and a modifier obtained from Process Applications, Ltd., under the trade name PALSOFT 580C.

Example 7 used the same PVOH and PAE resin as used in Examples 3-6 above; however, the modifier was a 90% methyl bis(oleylamidoethyl)2-hydroxyethyl ammonium methyl sulfate/10% isopropanol obtained from Goldschmidt, under the tradename VARISOFT 222LT.

Example 8 used the same PVOH and modifier as Example 7 but substituted a PAE resin obtained from Hercules Corp., under the trade name HERCULES 82-176.

The creping adhesive chemistry was applied in an amount of 1.5 lbs/ton. The creping blade angle was 15°. The reel crepe was 23%. The reel moisture was between about 1.8 and about 3.0. The basis weight of the base sheet was 11.5 lbs/ream (3000 $ft^2$).

Comparative Examples 9-13

Examples 9-13 were carried out in accordance with Examples 3-8 above, but using an adhesive of U.S. Pat. No. 5,853,539. This adhesive includes PVOH and PAE resin as used in Examples 3-8 above. The modifier used was an imidazoline-based quat, which included a mixture of cationic imadazolinium species, and other cyclic amine quats and salts. This modifier was obtained from Chemtreat Inc., based in Richmond, Va., under the trade name CHEMTREAT CR-208.

Table 3 provides various properties for Examples 3-8 and Comparative Examples 9-13.

TABLE 3

| | PVOH lb/T | PAE lb/T | Modifier lb/T | GMT g/3" | Average GMT g/3" | Caliper mils/ 8 shts | Average Caliper mils/ 8 shts | Porofil g/g | Average Porofil g/g |
|---|---|---|---|---|---|---|---|---|---|
| Example | | | | | | | | | |
| 3 | 0.7 | 0.7 | 0.1 | 300 | | 39.6 | | 9.09 | |
| 4 | 0.6 | 0.6 | 0.3 | 363 | | 38.8 | | 8.18 | |
| 5 | 0.5 | 0.5 | 0.5 | 394 | | 37.6 | | 8.53 | |
| 6 | 1 | 1 | 1 | 413 | 368 | 35.3 | 37.8 | 8.52 | 8.58 |
| 7 | 0.5 | 0.5 | 0.5 | 468 | | 37.4 | | 8.85 | |
| 8 | 0.4 | 0.4 | 0.7 | 378 | 423 | 37.1 | 37.3 | 8.99 | 8.92 |
| Comparative | | | | | | | | | |
| 9 | 0.7 | 0.7 | 0.1 | 490 | | 36.1 | | 7.80 | |
| 10 | 0.6 | 0.6 | 0.3 | 469 | | 36.4 | | 7.99 | |
| 11 | 0.5 | 0.5 | 0.5 | 501 | | 35.4 | | 8.10 | |
| 12 | 0.4 | 0.4 | 0.7 | 554 | | 34.2 | | 8.12 | |
| 13 | 1.2 | 1.2 | 0.6 | 430 | 489 | 35.7 | 35.6 | 8.22 | 8.05 |

The sheet creped using the adhesive according to the present invention exhibited lower geometric mean tensile strength, increased caliper, and enhanced Porofil values. The Porofil test method is provided in U.S. Pat. No. 5,494,554, which is incorporated herein by reference in its entirety. Porofil is measured using a non-polar liquid having a density of 1.875 $g/cm^3$. Void volume is expressed as grams of Porofil per gram of fiber and is calculated as void volume=(wet weight−dry weight)/dry weight. Further, use of the adhesive according to the present invention resulted in well-creped base sheets within the strength range for commercial tissue without the need for wet-end debonders.

Examples 14-16

A nascent web was formed by the process of U.S. Pat. No. 6,207,011, which is herein incorporated by reference. The furnish had a CSF of 500±20 ml. The sheet was creped from the Yankee dryer with a creping blade angle of 15°. The sheet temperature, as measured at the creping blade with an IR Gun, was in the range of between about 216° and 228° F. The sheet moisture at the creping doctor was between about 1.8% and about 3.5%.

The creping adhesives were loaded to the Yankee dryer by applying a base coating of adhesive at a rate of 1 lb/ton for 20 minutes with the cleaning blade loaded but set at a low line load. Next, a web was run and stabilized with a new creping blade having a blade thickness of 0.050" and at a 15° blade bevel for a time of 30 minutes.

After the sheet was stabilized for 30 minutes, sheet tension was recorded from an online tensiometer during each run. Tension was recorded as lbs. force/sheet width. The sheet width was 12 inch. Peel tension was also measured. Peel tension is the force in pounds per 12 inches of sheet width required to remove the web approximately 6 inches above the creping blade on the Yankee surface. The peel tension was recorded and used to measure the adhesion level of the different coating packages.

The Yankee surface was cleaned between adhesive runs with a cleaning solution containing 50 g of TRITON X100 and 25 g of Trisodium Phosphate in aqueous solution. The cleaning was carried out for 3 minutes to remove any coating build-up. The cleaning solution was removed using wet wipe on the loaded creping blade with the pressure roll open. The Yankee was cleaned a second time for 3 minutes using water.

The final base sheet had a basis weight of 20.5±0.5 lbs/ream.

Comparative Examples 17-22

Examples 17-22 were run as Examples 14-16 with the changes in ping adhesive composition noted in Table 4, below.

TABLE 4

| Ex. | Adhesive PAE lb/T | Adhesive PVOH or PAA lb/T | Modifier lb/T | Total add-on lb/T | Tension lb/12" | Peel Tension lb/12" | Porofil g/g | Caliper mils/8 shts | Modulus MD g/inch-% |
|---|---|---|---|---|---|---|---|---|---|
| 14 | 0.5 NALCO 675B | 0.5 NALCO 7538 | 0.2 PALSOFT 580C | 1.2 | 0.3 | — | 6.25 | 58.7 | 11.0 |
| 15 | 0.25 NALCO 690 HA | — | 0.05 PALSOFT 580C | 0.3 | 0.7 | 0.4 | 5.43 | 61.7 | 10.0 |
| 16 | 1 NALCO 690 HA | — | 0.2 PALSOFT 580C | 1.2 | 0.5 | 0.4 | 5.29 | 62.0 | 10.0 |
| 17 | 0.5 QUAKER A272 | 0.5 QUAKER A262 | 0.2 Q2008 | 1.2 | 0.8 | 0.55 | 5.43 | 58.5 | 13.0 |
| 18 | 1.5 QUAKER A272 | 1.5 QUAKER A262 | 0.6 Q2008 | 3.6 | 0.8 | 0.75 | 5.27 | 57.7 | 14.7 |
| 19 | 1 HERCULES 82-176 | — | 0.2 HERCULES 565 | 1.2 | 2.1 | 0.85 | 5.67 | 53.1 | 20.3 |
| 20 | 1 HERCULES 82-176 | — | 1 HERCULES 565 | 2 | 1.7 | 1 | 5.25 | 49.6 | 26.6 |
| 21 | — | 0.75 AIRVOL 540 | — | 0.75 | 0.95 | 0.3 | 5.30 | 61.7 | 15.5 |
| 22 | — | 0.5 AIRVOL 540 | — | 0.5 | 0.8 | 0.2 | 4.50 | 58.0 | 21.1 |

Note that Nalco 675B contains a pre-crosslinked PAE (polyaminamide epichlorhydrin) resin. Also, Nalco 7538 contains a glyoxalated polyacrylamide resin. Quaker A272 contains crosslinkable PAE, PEG 400, and polyphosphate. Furthermore, Quaker A262 contains PVOH and PEG 400. Q2008 contains an imidazoline quat. Hercules 82-176 contains a thermosetting PAE resin. Hercules 565 contains a mixture of mineral oil and PEG diester. Finally, Airvol 540 is an 87-89% hydrolyzed polyvinyl alcohol (PVOH) in the middle to low molecular weight range.

From Table 4, the inventive creping adhesive packages (Examples 14 through 16) gave good adhesion and machine runnability with base sheets having low modulus, high caliper and high void volume. These results persist even at the very low add-on level of 0.3 lbs/T (Example 15).

Examples 23-32 and Comparative Examples 33-36

Film property evaluations were conducted by preparing solutions in 20 ml glass vials. The solutions were mixed in a vortex mixer for 30 seconds. The ratios of the components were based on the total solids of the solution.

Films were formed by weighing an aliquot of each solution into an aluminum weighing dish that will dry to 0.5 gms of solids. The solutions were dried for 16 hours in a 105° C. forced-air oven. The dishes were removed from the oven and allowed to equilibrate to atmospheric conditions for 5 minutes prior to evaluations of dry tack, flexibility, wet tack, and re-wettability.

Dry tack was evaluated using the following method. After the oils were removed from the ball of the thumb of the tester using acetone, the thumb was pressed onto the film surface with a force of about 15 psi. The amount of time, measured in seconds that it took for the film and the dish to fall to the table, was recorded. A rating of "0" was given to films in dishes that did not lift from the test table. A rating of "3" was given if the film partially rose from the table. A rating of "5" was given when the film and dish lifted completely clear of the table.

Wet tack was evaluated using the following method. A one square inch piece of Georgia-Pacific Centerpull towel, wetted with tap water and the excess squeezed off, was pressed into the film with a force of about 15 psi. A rating of "0" was given to films in dishes that did not lift from the test table. A rating of "3" was given if the film partially rose from the table. A rating of "5" was given when the film and dish lifted completely clear of the table.

Flexibility and appearance were evaluated by removing the films from the aluminum dish and visually evaluating the clarity, uniformity, and flexibility of the films.

Rewettability was evaluated using the following method. A drop of tap water was placed on the dried film. These films were evaluated after about 5 minutes to determine whether the rewetted films had swelled, dissolved, become more flexible, or were rubbery.

Table 5 illustrates various properties of Examples 23-36.

TABLE 5

| Example No. | Component One (PVOH) | Component Two (PAE) | Modifier | Other additive | Film: Dry Tack | Film: Wet Tack | Re-wettability Of Oven Dried Films |
|---|---|---|---|---|---|---|---|
| 33 Prior Art Example | Airvol 523 (80%) | | Kalipol 18 (20%) | | 0 | 5 | Slightly Swelled |
| 34 Prior Art Example | Airvol 523 (93%) | | Kalipol 18 (7%) | | 0 | 5 | Slightly Swelled |
| 35 Prior Art Example | Airvol 523 PVOH (61.7%) | Nalco 690HA (33.3%) | Quaker 2008 (5%) | | 0 | 3 | Became Flexible and Dissolved |
| 36 Control | Airvol 523 (100%) | | | | 0 | 5 | Slightly Dissolved |
| 23 Invention | CR-170 (97%) | 82-176 (0.3%) | Palsoft 580C (2.7%) | | 3 | 5 | Swell, then Dissolved |
| 24 Invention | Airvol 523 (58%) | Nalco 690HA (39%) | Palsoft 580C (3%) | | 3 | 0 | Swelled |
| 25 Invention | Airvol 205 (95%) | | Palsoft 580C (5%) | | 3 | 5 | Swelled and Dissolved |
| 26 Invention | Airvol 205 (94%) | | Palsoft 580C (5%) | AZC (1%) | 3 | 5 | Swelled |
| 27 Invention | | Unicrepe C-77M (95%) | Palsoft 580C (5%) | | 3 | 3 | Swelled |
| 28 Invention | CR-167 (95%) | | Palsoft 580C (5%) | | 3 | 5 | Slightly Swelled |
| 29 Invention | Airvol 523 (39.4%) | Nalco 690HA (59.1%) | Palsoft 580C (1.5%) | | 5 | 5 | Slightly Swelled |
| 30 Invention | | Nalco 690HA (95%) | Palsoft 580C (5%) | | 5 | 5 | Swelled |
| 31 Invention | Airvol 523 (38%) | Nalco 690HA (57%) | Palsoft 580C (5%) | | 5 | 5 | Slightly Swelled |
| 32 Invention | Airvol 523 (59.1%) | Nalco 690HA (39.4%) | Palsoft 580C (1.5%) | | 5 | 5 | Slightly Swelled |

CHEMTREAT 170 is a blend of PVOH, PAE and additional nonionic compounds from ChemTreat, Inc. CHEMTREAT 167 is a blend of PAE, nonionic surfactants and MAMAP (monoammonium phosphate) from ChemTreat, Inc. AIRVOL 205 is a very low molecular weight, 87-89% hydrolyzed PVOH from Celanese Chemicals. UNICREPE C-77M is a thermosetting PAE (polyaminamide-epichlorohydrin) copolymer of adipic acid (AA) and glutaric acid. UNICREPE 920 is a thermosetting PAE (polyaminamide-epichlorohydrin) copolymer of adipic acid (AA) and glutaric acid. AZC is an ammonium zirconium carbonate (20% aqueous solution) from EKA Chemical.

When the modifier according to the present invention was added to the adhesive formula, the dry tack of the adhesives was significantly improved when compared with prior art adhesives alone or with prior art modifiers, (see Table 5). The improved dry tack exhibited by film containing the modifier according to the present invention establishes the improvement of the materials for use as a creping adhesive, since these materials would exhibit better adhesion during the very dry process conditions observed during low moisture creping processes.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of making a cellulosic web comprising:

forming a nascent web on a foraminous fabric, applying to a rotating creping cylinder at least one creping adhesive chosen from the group consisting of cationic creping adhesives and non-ionic creping adhesives, the at least one creping adhesive comprising at least one component chosen from a water-soluble polyamide resin and a film-forming crystalline polymer, the at least one component modified by a creping adhesive modifier comprising, as its predominant component, one or more non-cyclic bis-amide quaternary ammonium complexes, and pressing the cellulosic web against the creping cylinder to cause sheet transfer and adhesion of the web to the cylinder surface.

2. The method of claim 1, wherein said web is removed from said creping cylinder surface with a doctor blade.

3. The method of claim 1, wherein said web is removed from said creping cylinder surface with a roll.

4. The method of claim 1, wherein the at least one component is a water-soluble polyamide resin that is non-thermosetting.

5. The method of claim 1, wherein the at least one component is a water-soluble polyamide resin that is thermosetting.

6. The method of claim 1, wherein the at least one component is a film-forming semi-crystalline polymer chosen from hemicellulose, carboxymethyl cellulose, and polyvinyl alcohol.

7. The method of claim 1, wherein the at least one creping adhesive chosen from the group consisting of cationic creping adhesives and non-ionic creping adhesives comprises at least one inorganic cross-linking agent.

8. The method of claim 7, wherein the at least one inorganic cross-linking agent is a zirconium salt chosen from ammonium zirconium carbonate, zirconium acetylacetonate, zirconium acetate, zirconium carbonate, zirconium sulfate, zirconium phosphate, potassium zirconium carbonate, zirconium sodium phosphate, and sodium zirconium tartrate.

9. The method of claim 1, wherein the one or more non-cyclic bis-amide quaternary ammonium complexes comprise at least one amide containing group represented by the following formula structure:

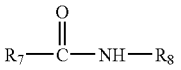

wherein R7 and R8 are the same or independently chosen non-cyclic molecular chains of organic or organic and inorganic atoms.

10. The method of claim 1, wherein the creping adhesive modifier comprises at least one non-cyclic bis-amide quaternary ammonium complex of the formula:

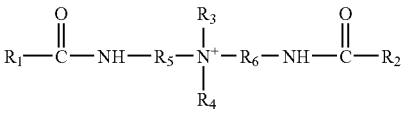

wherein $R_1$ and $R_2$ are the same or independently chosen from long chain non-cyclic saturated or unsaturated aliphatic groups; $R_3$ and $R_4$ are the same or independent chosen from long chain non-cyclic saturated or unsaturated aliphatic groups, an alkoxylated fatty acid, an alkoxylated fatty alcohol, a polyethylene oxide group, or an organic alcohol group; and $R_5$ and $R_6$ are the same or independently chosen from long chain non-cyclic saturated or unsaturated aliphatic groups.

11. The method of claim 1, wherein the creping adhesive modifier comprises methyl bis (oleylamidoethyl) 2-hydroxyethyl ammonium methyl sulfate.

12. The method of claim 1, wherein creping adhesive modifier comprises at least one non-cyclic bis-amide quaternary ammonium complex of the formula:

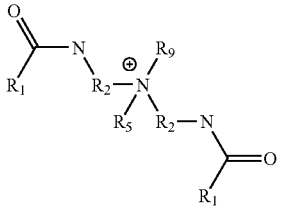

wherein each $R_1$ is a $C_{12}$-$C_{21}$ alkyl or alkylene group, each $R_2$ is a divalent alkylene group having 1 to 3 carbon atoms, and $R_5$ and $R_9$ are $C_1$-$C_4$ saturated alkyl or hydroxyalkyl groups.

13. A method of making a cellulosic web comprising:

forming a nascent web on a foraminous fabric, transferring the nascent web from one foraminous fabric to another foraminous through-air-drying fabric, partially drying the web to a solids level of from about 40% solids to about 98% solids on said through-air-drying fabric, applying to a rotating creping cylinder at least one creping adhesive chosen from the group consisting of cationic creping adhesives and non-ionic creping adhesives, the at least one creping adhesive comprising at least one component chosen from a water-soluble polyamide resin and a film-forming crystalline polymer, the at least one component modified by a creping adhesive modifier comprising, as its predominant component, one or more non-cyclic bis-amide quaternary ammonium complexes, and pressing the cellulosic web against the creping cylinder to cause sheet transfer and adhesion of the web to the cylinder surface.

14. The method of claim 13, wherein said web is removed from said creping cylinder surface with a doctor blade.

15. The method of claim 13, wherein said web is removed from said creping cylinder surface with a roll.

16. The method of claim 13, wherein the at least one component is a water-soluble polyamide resin that is non-thermosetting.

17. The method of claim 13, wherein the at least one component is a water-soluble polyamide resin that is thermosetting.

18. The method of claim 13, wherein the at least one component is a film-forming semi-crystalline polymer chosen from hemicellulose, carboxymethyl cellulose, and polyvinyl alcohol.

19. The method of claim 13, wherein the at least one creping adhesive chosen from the group consisting of cationic creping adhesives and non-ionic creping adhesives comprises at least one inorganic cross-linking agent.

20. The method of claim 19, wherein the at least one inorganic cross-linking agent is a zirconium salt chosen from ammonium zirconium carbonate, zirconium acetylacetonate, zirconium acetate, zirconium carbonate, zirconium sulfate, zirconium phosphate, potassium zirconium carbonate, zirconium sodium phosphate, and sodium zirconium tartrate.

21. The method of claim 13, wherein the one or more non-cyclic bis-amide quaternary ammonium complexes comprise at least one amide containing group represented by the following formula structure:

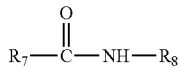

wherein R7 and R8 are the same or independently chosen non-cyclic molecular chains of organic or organic and inorganic atoms.

22. The method of claim 13, wherein the creping adhesive modifier comprises at least one non-cyclic bis-amide quaternary ammonium complex of the formula:

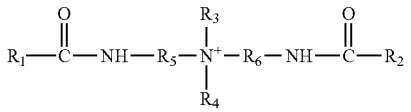

wherein $R_1$ and $R_2$ are the same or independently chosen from long chain non-cyclic saturated or unsaturated aliphatic groups; $R_3$ and $R_4$ are the same or independent chosen from long chain non-cyclic saturated or unsaturated aliphatic groups, an alkoxylated fatty acid, an alkoxylated fatty alcohol, a polyethylene oxide group, or an organic alcohol group; and $R_5$ and $R_6$ are the same or independently chosen from long chain non-cyclic saturated or unsaturated aliphatic groups.

23. The method of claim 13, wherein the creping adhesive modifier comprises methyl bis (oleylamidoethyl) 2-hydroxyethyl ammonium methyl sulfate.

24. The method of claim 13, wherein the creping adhesive modifier comprises at least one non-cyclic bis-amide quaternary ammonium complex of the formula:

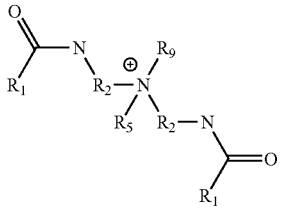

wherein each $R_1$ is a $C_{12}$-$C_{21}$ alkyl or alkylene group, each $R_2$ is a divalent alkylene group having 1 to 3 carbon atoms, and $R_5$ and $R_9$ are $C_1$-$C_4$ saturated alkyl or hydroxyalkyl groups.

25. A method of making a cellulosic web comprising:

forming a nascent web on a foraminous fabric, applying to a rotating creping cylinder at least one creping adhesive chosen from the group consisting of cationic creping adhesives and non-ionic creping adhesives, the at least one creping adhesive, comprising at least one component chosen from a water-soluble polyamide resin and a film-forming crystalline polymer, the at least one component modified by a creping adhesive modifier comprising, as its predominant component, one or more non-cyclic bis-amide quaternary ammonium complexes, wherein the modified creping adhesive exhibits at least one property chosen from increased dry tack and reduced brittleness, and pressing the cellulosic web against the creping cylinder to cause sheet transfer and adhesion of the web to the cylinder surface.

26. The method of claim 25, wherein said web is removed from said creping cylinder surface with a doctor blade.

27. The method of claim 25, wherein said web is removed from said creping cylinder surface with a roll.

28. The method of claim 25, wherein the at least one component is a water-soluble polyamide resin that is non-thermosetting.

29. The method of claim 25, wherein the at least one component is a water-soluble polyamide resin that is thermosetting.

30. The method of claim 25, wherein the at least one component is a film-forming semi-crystalline polymer chosen from hemicellulose, carboxymethyl cellulose, and polyvinyl alcohol.

31. The method of claim 25, wherein the at least one creping adhesive chosen from the group consisting of cationic creping adhesives and non-ionic creping adhesives comprises at least one inorganic cross-linking agent.

32. The method of claim 31, wherein the inorganic cross-linking agent is a zirconium salt chosen from ammonium zirconium carbonate, zirconium acetylacetonate, zirconium acetate, zirconium carbonate, zirconium sulfate, zirconium phosphate, potassium zirconium carbonate, zirconium sodium phosphate, and sodium zirconium tartrate.

33. The method of claim 25, wherein the one or more non-cyclic bis-amide quaternary ammonium complexes comprise at least one amide containing group represented by the following formula structure:

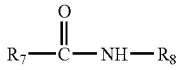

wherein R7 and R8 are the same or independently chosen non-cyclic molecular chains of organic or organic and inorganic atoms.

34. The method of claim 25, wherein the creping adhesive modifier comprises at least one non-cyclic bis-amide quaternary ammonium complex of the formula:

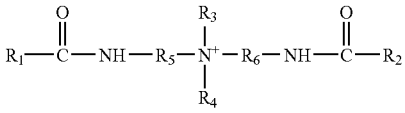

wherein $R_1$ and $R_2$ are the same or independently chosen from long chain non-cyclic saturated or unsaturated aliphatic groups; $R_3$ and $R_4$ are the same or independent chosen from long chain non-cyclic saturated or unsaturated aliphatic groups, an alkoxylated fatty acid, an alkoxylated fatty alcohol, a polyethylene oxide group, or an organic alcohol group; and $R_5$ and $R_6$ are the same or independently chosen from long chain non-cyclic saturated or unsaturated aliphatic groups.

35. The method of claim 25, wherein the creping adhesive modifier comprises methyl bis (oleylamidoethyl) 2-hydroxyethyl ammonium methyl sulfate.

36. The method of claim 1, wherein the creping adhesive modifier comprises at least one non-cyclic bis-amide quaternary ammonium complex of the formula:

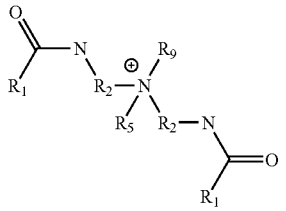
wherein each $R_1$ is a $C_{12}$-$C_{21}$ alkyl or alkylene group, each $R_2$ is a divalent alkylene group having 1 to 3 carbon atoms, and $R_5$ and $R_9$ are $C_1$-$C_4$ saturated alkyl or hydroxyalkyl groups.
* * * * *